US005647923A

United States Patent [19]

Buescher

[11] Patent Number: 5,647,923

[45] Date of Patent: Jul. 15, 1997

[54] METHOD FOR PRODUCING REFRACTORY METAL FOIL

[75] Inventor: Conor Buescher, Albany, Oreg.

[73] Assignee: Teledyne Industries, Inc., Albany, Oreg.

[21] Appl. No.: 501,926

[22] Filed: Jul. 13, 1995

[51] Int. Cl.[6] ..... C22F 1/18

[52] U.S. Cl. ..... 148/672; 148/668; 29/17.2

[58] Field of Search ..... 148/668, 669, 148/670, 671, 672, 673; 29/17.1, 17.2

[56] References Cited

U.S. PATENT DOCUMENTS

| | | | |
|---|---|---|---|
| 3,188,206 | 6/1965 | Michael . | |
| 4,462,236 | 7/1984 | Turley et al. | 72/242 |
| 4,531,394 | 7/1985 | Turley et al. | 72/238 |
| 4,551,878 | 11/1985 | Turley et al. | 15/102 |
| 4,745,556 | 5/1988 | Turley | 364/472 |
| 4,843,673 | 7/1989 | Sendzimir et al. | 15/102 |

OTHER PUBLICATIONS

Grobstein, T. L. et al., "Characterization of Precipitates in a Niobium–Zirconium–Carbon Alloy", DOE/NASA/16310–6, NASA TM–100848, Metallurgical Society Fall Meeting, Orlando, Florida, Oct. 5–9, 1986, pp. 1–13.

Hobson, David O., "A Preliminary Study of the Aging Behavior of . . . ", Oak Ridge National Laboratory, ORNL–2995, Jan. 27, 1961, pp. 1–26.

Wadsworth, J., et al., "Evidence for Dislocation Glide Controlled Creep in Niobium–Base Alloys", Scripta Metallurgica et Materialia, vol. 27, 1992, pp. 71–76.

Titran, R. H., "Long–Time Creep Behavior of Nb–1Zr Alloy Containing Carbon" DOE/NASA/16310–4, NASA TM–100142, 1986 TMS–AIME Fall Meeting, Orlando, Florida Oct. 5–9, 1986, pp. 1–10.

*Primary Examiner*—John Sheehan

*Attorney, Agent, or Firm*—Shoemaker and Mattare, Ltd.

[57] ABSTRACT

A method for producing a refractory metal foil from a workpiece fabricated of a refractory metal material includes the step of heat treating the workpiece for a first time period of approximately 1.5 hours at a first temperature of approximately 2,650° Fahrenheit and subsequently for a second time period of approximately 2.0 hours at a second temperature of approximately 2,200° Fahrenheit. The next step is forming the workpiece into a sheet of refractory metal material having a first sheet thickness of approximately one inch. The next step is heat treating the sheet of refractory metal material for a third time period of approximately 2 hours at a third temperature of approximately 2,200° Fahrenheit. The next step is compressing the sheet of refractory metal material into a second sheet thickness of approximately 0.040 inches. The next step is annealing the sheet of refractory metal material for a first annealing time period for approximately 2.0 hours at a first annealing temperature of approximately 2,200° Fahrenheit. The next step is compressing the sheet of refractory metal material into a third sheet thickness of approximately 0.010 inches. The next step is annealing the sheet of refractory metal material for a second annealing time period of approximately 3.0 hours at a second annealing temperature of approximately 2,100° Fahrenheit. The final step is compressing the sheet of refractory metal material into a fourth sheet thickness of approximately 0.0010 inches thereby forming a foil of refractory metal material.

29 Claims, 3 Drawing Sheets

METHOD FOR PRODUCING REFRACTORY METAL FOIL

FIELD OF THE INVENTION

The present invention relates to a method for producing a refractory metal foil from a workpiece slab of refractory metal. More particularly, the present invention is directed to producing a niobium alloy foil from a workpiece slab of a niobium alloy.

BACKGROUND OF THE INVENTION

Modern medical techniques have made it possible to conduct non-invasive testing of the human body to detect a variety of internal growths and abnormalities. Specifically, magnetic medical imaging equipment that employs huge electromagnets can scan the entire human body or any desired part thereof to assist the physician in diagnosing patient ailments. Usually, these huge electromagnets are fabricated from coils of superconductor metal foil such as a tin coated niobium alloy foil which contains a niobium tin superconductor alloy. Although the process for fabricating these coils has been used in industry for quite some time, there have been unsolved problems in the prior production processes.

Long-length niobium alloy foil is required to produce the superconductor windings for the electromagnet used in medical imaging equipment. Typically, "long length" is at least 3,000 feet long although "long length" can be as long as 9,000 feet. Foil thickness is typically in a range of 0.005 inches and 0.0008 inches. The prior art method for producing a niobium metal alloy foil begins by forming a workpiece slab of preferably niobium 1% by weight zirconium alloy metal having a thickness of approximately 3 inches into a sheet of niobium zirconium alloy metal having a thickness of approximately 0.040 inches. Typically, this is achieved on a standard 4-high cold mill. Thereafter, a conventional foil mill such as a sendzimiror Z-mill is used to compress the 0.040 inch niobium zirconium alloy metal sheet to a final foil gauge thickness such as 0.010 inches or some other selected gauge thickness. The Z-mill is typically one of the kind manufactured by Waterbury Farrel Founding and Machine Company of Waterbury, Conn.

The compressed sheet is simultaneously collected and rolled into a coil in one of two coil assemblies disposed on opposite sides of the rollers depending upon the direction that the sheet passes through the rollers. Of course, as one coil assembly receives the compressed sheet from the rollers the opposite coil assembly discharges the sheet by unwrapping the coil collected therein. Typically, each these coil assemblies applied a high tension force to the sheet to achieve the required foil gauge thickness. The receiving coil assembly applied a high receiving tension force to the sheet as it is being received from the rollers thereby inducing a pulling force to the sheet into the receiving coil. The discharging coil assembly applied a discharge tension force to the sheet which is equal in magnitude to the receiving tension force as the sheet was discharged from the discharging coil assembly thereby inducing a force which resisted being pulled by the rollers. These tension forces can cause the sheet to crease and wrinkle which is undesirable when forming a refractory metal foil. Also, these tension forces caused an inconsistent cross-sectional sheet profile in the foil.

Typically, the workpiece slab is forged into a thickness of approximately 3 inches. Forging usually causes oxide compounds to form along the lateral edges of the slab. As the workpiece slab is rolled i.e., compressed and reduced to a sheet, these oxide compounds can form inclusions which can cause cracking along the lateral edges of the sheet during further reduction processing. This cracking can subsequently cause catastrophic breakage of the foil.

One manufacturer of long-length refractory metal foil attempted to produce a long-length foil by welding two foils together along their ends at a stage where the thicknesses of the foils were 0.040 inches. This weld was approximately one inch in length that connected the two foils. After reducing the thickness of the "long-length" foil to 0.001 inches, the weld became 40 inches in length. Furthermore, this 40-inch weld often contained numerous pinholes throughout its surface area and could later break. Breakage could be particularly catastrophic after processing the foil into a superconductor surface.

Once the sheet of niobium zirconium alloy foil was reduced in thickness to approximately 0.040 inches and rolled into a coil, the coil was annealed in a furnace for 2 hours at 2,200° Fahrenheit. In production processes, this annealing process can produce a coil with un-annealed surface areas. Coils that are un-annealed develop areas of excessive dislocation stress throughout the metal matrix during subsequent rolling. Generally, these un-annealed areas are located in the middle of the coil, the location that is the most difficult to anneal. Upon subsequent rolling to a thinner thickness, breakage of the foil at these locations can occur.

After annealing the coil must be mounted onto the Z-mill once again so that the foil could be rolled to a smaller thickness. As the coil becomes unwrapped after annealing, sometimes the facially contacting surfaces of the foil stick together, thus, destroying the foil. It is believed that non-homogeneous annealing causes the facially contacting surfaces of the foil to stick together.

All of these problems either individually or in combination with each other led to an inability to consistently produce a high quality, dimensionally consistent long-length foil. Therefore, there is a need in the industry to produce a refractory metal foil from a workpiece slab of refractory metal which consistently yields a desirable sheet thickness and shape, as well as a quality, long-length refractory metal foil. It would be advantageous if the workpiece slab of refractory metal is subjected to homogeneous annealing to prevent un-annealed areas in the middle of the coil. It would also be advantageous if the oxide compounds are first removed from the lateral edges of the workpiece to prevent edge cracking and subsequent catastrophic breakage of the foil. There is need in the industry to produce a refractory metal foil that is devoid of excessive dislocation stress. It would be advantageous if a long-length, i.e. greater than 3,000 feet, refractory metal foil could be produced without having to weld two sheets together. There is also a need in the industry to produce a refractory metal foil so that it could be rolled into a coil for annealing purposes and thereafter unwrapped for further reduction in thickness without the facially contacting surfaces sticking together. There is a need in the industry for method to produce a refractory metal foil that employs a lower tension methodology when compressing the refractory metal in a Z-mill into a reduced thickness. It would also be advantageous if a sheet receiving tension force is generated that is slightly less than a sheet discharging tension force. The present invention satisfies these needs and provides these advantages.

OBJECTS OF THE INVENTION

An object of the present invention is to provide a method for producing a refractory metal foil such as preferably a niobium 1% by weight zirconium alloy foil from a workpiece slab of the alloy.

Another object of the present invention is to provide a method for producing a refractory metal foil from a workpiece slab of refractory metal which consistently yields a consistent thickness and sheet shape in particular with clean sharp edges thereby producing a quality, long-length refractory metal foil.

Yet another object of the present invention is to provide a method for producing a refractory metal foil from a workpiece slab of refractory metal in which homogeneous annealing of the refractory metal as it proceeds through the method can be achieved.

A further object of the present invention is to provide a method for producing a refractory metal foil where oxide compounds are removed from the lateral edges of the workpiece to prevent edge cracking and subsequent catastrophic breakage of the foil.

A still further object of the present invention is to provide a method for producing a refractory metal foil that is devoid of excessive dislocation stress.

Another object of the present invention is to provide a method for producing a long-length, i.e. greater than 3,000 feet, refractory metal foil without having to weld two sheets together.

Yet another object of the present invention is to provide a method for producing a refractory metal foil so that it could be rolled into a coil for annealing purposes and thereafter unwrapped for further reduction in thickness without the facially contacting surfaces sticking together.

A further object of the present invention is to provide a method for producing a refractory metal foil that employs a lower tension methodology when compressing the refractory metal in a Z-mill into a reduced thickness with a sheet receiving tension force being slightly less than a sheet discharging tension force.

SUMMARY OF THE INVENTION

Accordingly, a new and improved method for producing a refractory metal foil from a workpiece fabricated of a refractory metal material is hereinafter described. It is preferred that the refractory metal foil is a niobium zirconium alloy and that the workpiece has a workpiece thickness of at least 2.5 inches and a pair of oppositely disposed, parallel lateral edges. The first step includes heat treating the workpiece for a first time period selected from a first time range of approximately 1.2 hours and 1.8 hours at a first temperature selected from a first temperature range of approximately 2,625° Fahrenheit and 2,675° Fahrenheit and subsequently for a second time period selected from a second time range of approximately 1.7 hours and 2.3 hours at a second temperature selected from a second temperature range of approximately 2,175° Fahrenheit and 2,225° Fahrenheit. The next step includes forming the heat-treated workpiece into a sheet of refractory metal material having a first sheet thickness of approximately one inch. The next step includes heat treating the sheet of refractory metal material for a third time period selected from a third time range of approximately 1.8 hours and 2.2 hours at a third temperature selected from a third temperature range of approximately 2,175° Fahrenheit and 2,225° Fahrenheit. The next step includes compressing the sheet of refractory metal material into a second sheet thickness in a second sheet thickness range between 0.060 inches and 0.021 inches. The following step includes annealing the sheet of refractory metal material for a first annealing time period selected from a first annealing time range of approximately 1.8 and 2.2 hours at a first annealing temperature selected from a first annealing temperature range of approximately 2,175° Fahrenheit and 2,225° Fahrenheit. The next step is compressing the sheet of refractory metal material into a third sheet thickness in a third sheet thickness range of 0.006 inches and 0.021 inches. The next step is annealing the sheet of refractory metal material for a second annealing time period selected from a second annealing time range of approximately 2.8 hours and 3.2 hours at a second annealing temperature selected from a second annealing temperature range of approximately 2,075° Fahrenheit and 2,125° Fahrenheit. The final step includes compressing the sheet of refractory metal material into a fourth sheet thickness in a fourth sheet thickness range between 0.005 inches and 0.0008 inches thereby forming a foil of refractory metal material.

Preferably, the method of the present invention includes the step of grinding the lateral edges of the heat-treated workpiece sheets after any or all of the heat treating steps so that oxide compounds formed during heat treating the workpiece sheets are removed from the lateral edges of the workpiece.

It is further preferred that the method of the present invention includes compressing the sheet of refractory metal material into the third sheet thickness and the fourth sheet thickness as hereinbefore described in a Z-mill. As previously discussed, the Z-mill includes a roller assembly having at least a pair of rollers disposed in a parallel relationship and cooperative with one another. The roller assembly is operative to compress the sheet of refractory metal material as the sheet passes through and between the pair of rollers. The Z-mill also includes a pair of coiling assemblies. Each coiling assembly is disposed on opposite sides of the roller assembly so that when the sheet of refractory metal material passes through and between the pair of rollers, one of the coiling assemblies is operative to receive the sheet of refractory metal material thereby forming a coil of refractory metal material. Simultaneously therewith, the remaining one of the coil assemblies is operative to discharge the sheet of refractory metal material thereby unwrapping the coil of refractory metal material.

As one of the coil assemblies receives the sheet of refractory metal material to form the coil, the one of the coil assemblies is operative to apply a receiving tension force to the sheet as it passes through and between the pair of rollers of the roller assembly. As a remaining one of the coil assemblies discharges the sheet of refractory metal material, the remaining one of the coil assemblies is operative to apply a discharging tension force to the sheet as it passes between and through the pair of rollers of the roller assembly from the remaining one of the coiling assemblies. According to the preferred practice of the present invention, the discharging tension force is preselected to be greater than the receiving tension force.

The annealing steps for the sheets of refractory metal material are preferably conducted in a furnace having a heating chamber sized and adapted to receive the coil of refractory metal material. The coil of refractory metal material is disposed inside the heating chamber when the heating chamber is at an ambient temperature. Then, the heating chamber with the coil of refractory metal disposed therein is subsequently heated to the annealing temperature at a conventional heat-up rate preselected for the materials employed.

The practice of the present invention will become more readily appreciated and understood from consideration of the following detailed description of the preferred embodiment of the present invention when taken conjunction with the accompanying drawings, in which:

DETAILED DESCRIPTION OF THE PREFERRED EMBODIMENT

The present invention is a method for producing a niobium zirconium alloy foil from a workpiece fabricated of a niobium zirconium alloy. Preferably, the amount of niobium is 1% by weight of the niobium zirconium alloy. However, one of ordinary skill in the art would appreciate that the niobium zirconium alloy is a refractory metal material and that any refractory metal material having the appropriate metallurgical characteristics for forming into a foil can also be employed by the method of the present invention.

Figure 1:
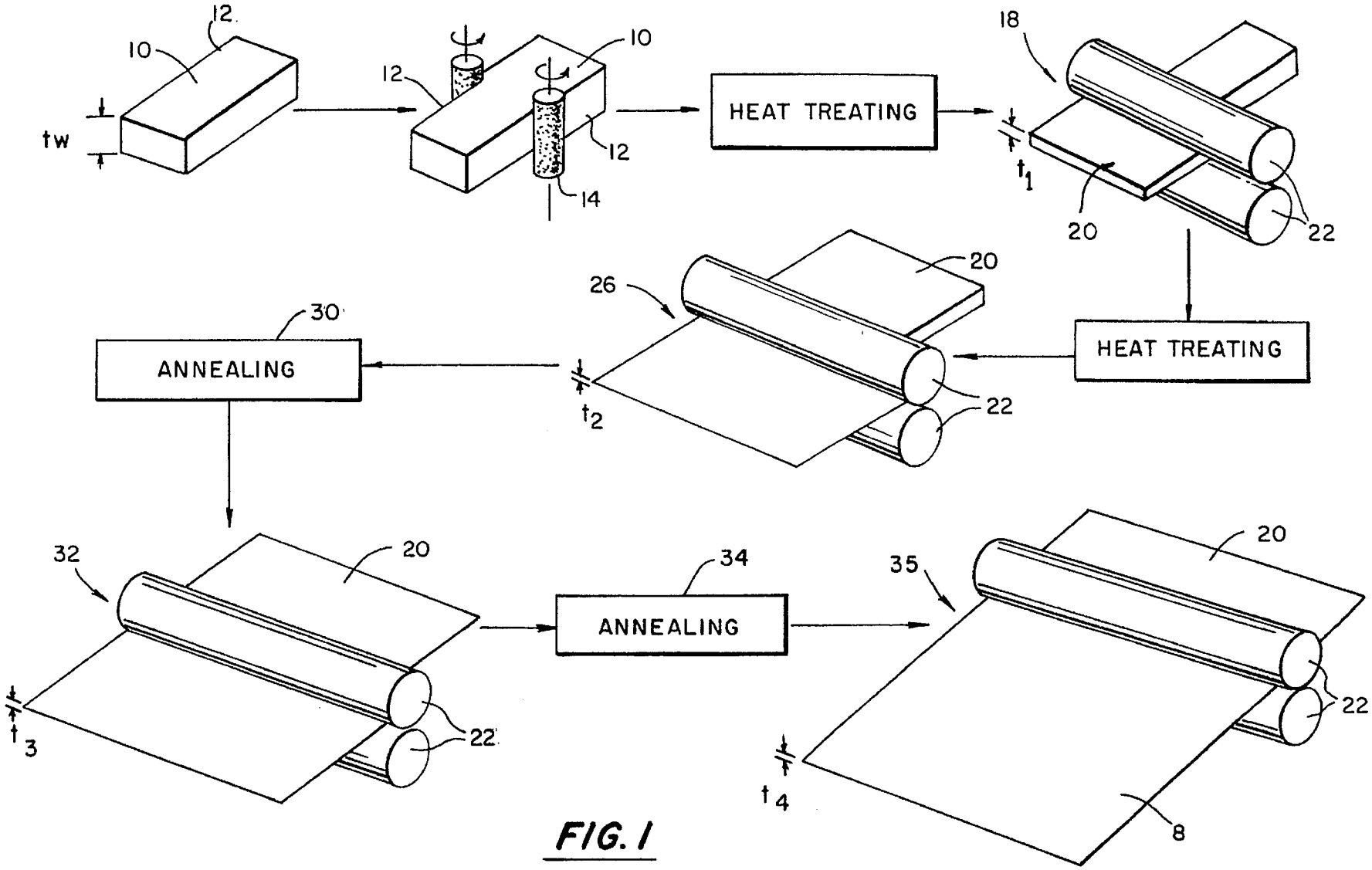
FIG. 1 is a schematic flow chart of a method of the present invention for producing a refractory metal foil.
Figure 2:
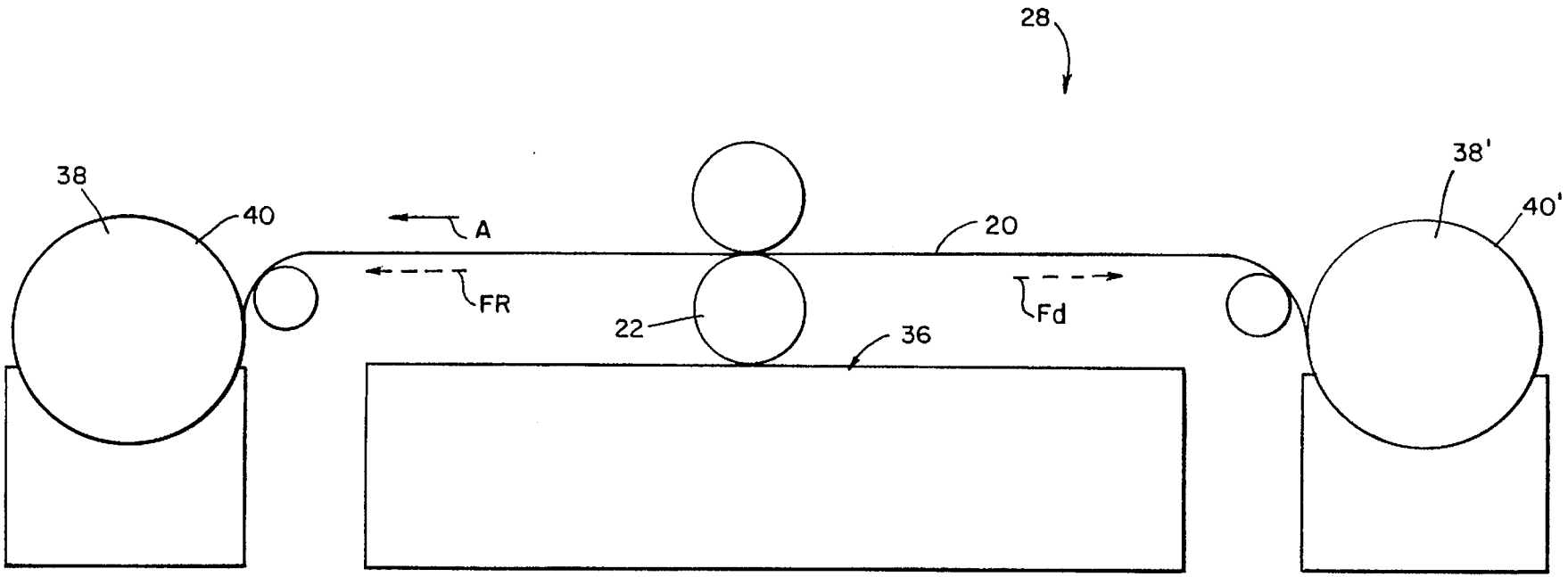
FIG. 2 is a schematic diagram of a Z-mill with a pair of rollers compressing a sheet of the refractory metal material to a small thickness and a pair of coil assemblies, one receiving and coiling the sheet of refractory metal material and the other discharging and unwrapping a coil of refractory metal material.
Figure 3:
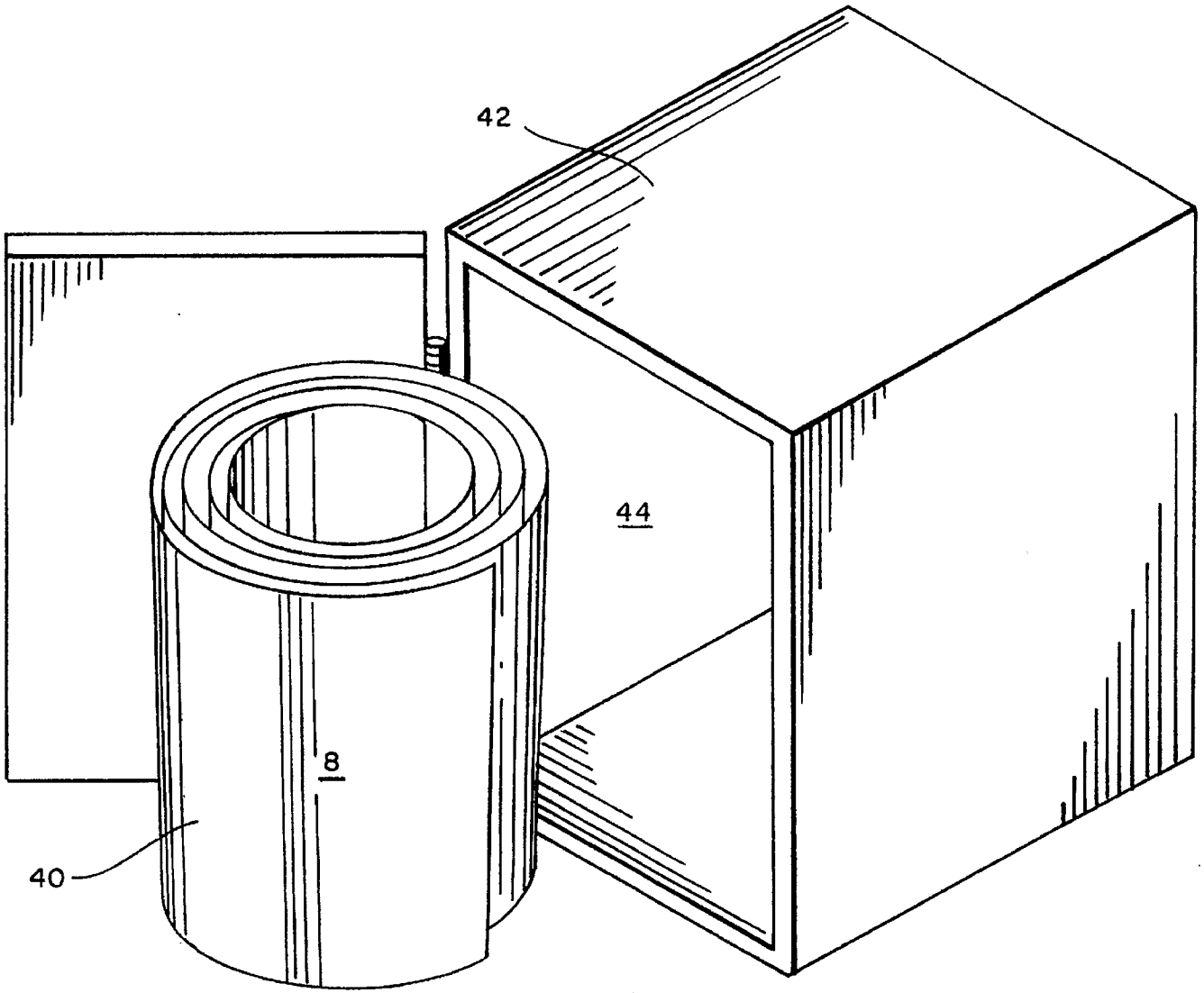
FIG. 3 is a perspective view of a coil of refractory metal material disposed near a heating chamber of an annealing furnace.

A method of the present invention for producing a niobium zirconium alloy foil 8 (labeled at the bottom of FIG. 1) is generally introduced in FIGS. 1–3. In FIG. 1, the method of the present invention begins from a workpiece 10 in a form of a workpiece slab fabricated of a niobiun zirconium alloy. Workpiece 10 has a workpiece thickness "$t_w$" of at least 2.5 inches and a pair of oppositely disposed, parallel lateral edges 12. Usually, workpiece 10 is fabricated by forging which causes oxide compounds to form particularly along lateral edges 12. If workpiece 10 is forged, the first step of the present method is grinding (step 14) lateral edges 12 of workpiece 10 so that oxide compounds formed during forging of workpiece 10 are removed from lateral edges 12. Removing oxide compounds from lateral edges 12 of workpiece 10 helps to prevent edge cracking during subsequent thickness reduction steps and therefore reduces the occurrence of catastrophic breakage of niobium zirconium alloy foil 8.

The next step of the method of the present invention is heat treating (step 16) workpiece 10 for a first time period selected from a first time range of approximately 1.2 hours and 1.8 hours at a first temperature selected from a first temperature range of approximately 2,625° Fahrenheit and 2,675° Fahrenheit and subsequently for a second time period selected from a second time range of approximately 1.7 hours and 2.3 hours at a second temperature selected from a second temperature range of approximately 2,175° Fahrenheit and 2,225° Fahrenheit. Heat treating step 16 homogenizes the niobium zirconium alloy. By way of example and not of limitation, it is preferred that the first and second time periods are approximately 1.5 hours and 2.0 hours respectively and that first and second temperatures are approximately 2,650° Fahrenheit and 2,200° Fahrenheit respectively.

After heat treating step 16, the next step is forming (18) heat-treated workpiece 10 into a sheet 20 of niobium zirconium alloy having a first sheet thickness "$t_1$" of approximately one inch. Although not by way of limitation, heat-treated workpiece 10 is compressed between two rollers 22 in order to reduce thickness "$t_w$" of workpiece 10 to first sheet thickness "$t_1$" of sheet 20. Two rollers 22 are conventional rollers of a standard 4-high cold mill or some other conventional roller mill commonly known and used in the industry.

After forming step 18, i.e. reducing thickness "$t_w$" of workpiece 10 to first sheet thickness "$t_1$" of sheet 14, the next step of the method of the present invention is heat treating (step 24) sheet 14 of niobium zirconium alloy for a third time period selected from a third time range of approximately 1.8 hours and 2.2 hours at a third temperature selected from a third temperature range of approximately 2,175° Fahrenheit and 2,225° Fahrenheit. It is preferable that the third time period is approximately 2 hours and the third temperature is approximately 2,200° Fahrenheit. Once again, heat treating step 24 homogenizes the niobium zirconium alloy of sheet 20.

The next step is compressing (step 26) sheet 20 of niobium zirconium alloy into a second sheet having a thickness "$t_2$" in a second sheet thickness range between 0.060 inches and 0.021 inches, although it is preferred that second sheet thickness "$t_2$" is approximately 0,040 inches. Again, not by way of limitation, heat-treated workpiece 10 is compressed between two rollers 22 in order to reduce thickness "$t_1$" of workpiece 10 to first sheet thickness "$t_2$" of sheet 20. Two rollers 22 are again conventional rollers of a standard 4-high cold mill or some other conventional roller mill commonly known and used in the industry.

After compressing step 26, the following step is annealing (step 30) sheet 20 of niobium zirconium alloy for a first annealing time period selected from a first annealing time range of approximately 1.8 and 2.2 hours at a first annealing temperature selected from a first annealing temperature range of approximately 2,175° Fahrenheit and 2,225° Fahrenheit. Preferably, the first annealing time period is approximately 2 hours and the first annealing temperature is approximately 2,200° Fahrenheit.

Upon completion of annealing step 30, the next step is compressing (step 32) the sheet of niobium zirconium alloy into a third sheet thickness "$t_3$" in a third sheet thickness range of approximately 0.006 inches and 0.021 inches. It is preferred that the third sheet thickness is approximately 0.010 inches. With reference to FIG. 2, compressing (step 32) sheet 20 of niobium zirconium alloy into second sheet thickness "$t_3$" is conducted in a Z-mill 28 (previously described) which is discussed in further detail below.

Thereafter, the next step is annealing (step 34) the sheet of niobium zirconium alloy for a second annealing time period selected from a second annealing time range of approximately 2.8 hours and 3.2 hours at a second annealing temperature selected from a second annealing temperature range of approximately 2,075° Fahrenheit and 2,125° Fahrenheit. Preferably, the second annealing time period is 3.0 hours and the second annealing temperature is 2,100° Fahrenheit. Then, the next step is compressing (step 35) the sheet of niobium zirconium alloy into a fourth sheet thickness "$t_4$" in a fourth sheet thickness range between 0.005 inches and 0.0008 inches thereby forming a foil of niobium zirconium alloy although it is preferred that fourth sheet thickness "$t_4$" is 0.001 inches. Compressing step 35 also occurs by employing Z-mill 28.

With reference to FIG. 2, Z-mill 28, as with any conventional Z-mill, includes a roller assembly 36. Since Z-mill 28 is a conventional Z-mill, discussion of its components shall be limited to how Z-mill 28 operates with the method of the present invention. While conventional Z-mill practiced as modified herein will produce the results described, one of ordinary skill in the art of foil production would appreciate that compressing a sheet and rolling it into a coil can be achieved by other equipment. Roller assembly 36 has at least the pair of rollers 22 disposed in a parallel relationship and are cooperative with one another. As stated above, rollers 22 of roller assembly 36 are operative to compress sheet 20 of niobium zirconium alloy as sheet 20 passes through and between the pair of rollers 22.

Further, Z-mill 28 includes a pair of coiling assemblies 38 and 38' with each coiling assembly 38 and 38' disposed on opposite sides of roller assembly 36 as shown in FIG. 2. Now, when sheet 20 of niobium zirconium alloy passes through and between the pair of rollers 22, one of coiling assemblies 38 or 38' is operative to receive sheet 20 of niobium zirconium alloy while simultaneously therewith a remaining one of coil assemblies 38 or 38' discharges sheet 20 of niobium zirconium alloy. One skilled in the art would appreciate that sheet 20 of niobium zirconium alloy passes back and forth between coil assemblies 38 and 38'. Therefore, by way of example only, sheet 20 travels in a direction shown by arrow "A". As a result, sheet 20 is received by coil assembly 38 thus forming a coil 40 of niobium zirconium alloy and the remaining one of coil assemblies 38' is operative to discharge sheet 20 of niobium zirconium alloy thereby unwrapping a coil 40' of niobium zirconium alloy.

As one of coil assemblies, i.e. coil assembly 38, receives sheet 20 of niobium zirconium alloy to form coil 40, that one coil assembly 38 is operative to apply a receiving tension force "$F_r$" in a direction of dashed arrow to sheet 20 as it passes through and between the pair of rollers 22 of roller assembly 36. Simultaneously therewith, while a remaining one of coil assemblies, i.e. coil assembly 38' discharges sheet 20 of niobium zirconium alloy, the remaining one of coil assemblies, coil assembly 38', is operative to apply a discharging tension force "$F_d$" in a direction of dashed arrow to sheet 20 as it passes through and between the pair of rollers 22 of roller assembly 36 from the remaining one of coiling assemblies, coiling assembly 38'. The discharging tension force "$F_d$" is greater than receiving tension force "$F_r$". As a result, with the discharging tension force "$F_d$" being greater than receiving tension force "$F_r$" the method of the present invention can employ a lower tension methodology compared to the prior art methods of producing a refractory metal foil. This lower tension methodology affords a Z-mill operator more control over the method of the present invention. Additionally, this lower tension methodology has been empirically proven to substantially reduce creasing and wrinkling of the sheet while being compressed and contributes to the formation of a more uniform thickness profile in the finished foil.

While compressing the sheet of niobium zirconium alloy during one experiment, the varying tension forces employed at corresponding sheet thicknesses were compiled and are reflected in Table I below.

TABLE I

| Thickness (inches) | Discharging Tension Force (lbs.) | Receiving Tension Force (lbs.) |
|---|---|---|
| 0.00305 | 1,000 | 900 |
| 0.00268 | 900 | 900 |

TABLE I-continued

| Thickness (inches) | Discharging Tension Force (lbs.) | Receiving Tension Force (lbs.) |
|---|---|---|
| 0.00211 | 900 | 800 |
| 0.00180 | 700 | 500 |
| 0.00153 | 600 | 500 |
| 0.00130 | 550 | 400 |
| 0.00110 | 500 | 350 |
| 0.00100 | 400 | 300 |

Compressing the sheet of niobium zirconium alloy in this manner and while employing the other steps of the present invention, niobium zirconium foil has been produced in lengths of approximately 9,000 feet with no wrinkles, creases or cobbles that are sometimes associated with previous rolling practices.

In FIG. 3, annealing the sheet of niobium zirconium alloy includes a furnace 42 having a heating chamber 44. Since furnace 42 is a standard one normally used in common annealing processes, no further discussion is deemed necessary about its components or operation. Heating chamber 44 is sized and adapted to receive coil 40 of niobium zirconium alloy. Coil 40 of niobium zirconium alloy is disposed inside heating chamber 44 which is originally at an ambient temperature. Heating chamber 44 with coil 40 of refractory metal now enclosed therein is subsequently heated to the annealing temperature at a conventional heat-up rate preselected for the materials being used.

The method of the present invention is a new and improved method for producing a refractory metal foil such as niobium zirconium alloy foil from a workpiece slab of refractory metal such as niobium zirconium alloy which is preferably 1% by weight of niobium. It has been empirically determined that the method of the present invention for producing a refractory metal foil from a workpiece slab of refractory metal has consistently yielded a desirable quality, long-length refractory metal foil as well as a desirable cross-sectional sheet shape. It has been empirically determined that the annealing steps of the method of the present invention produces homogeneous annealing of the refractory metal. As a result, the method of the present invention produces a refractory metal foil that is devoid of excessive dislocation stress. By employing the method of the present invention, producing a long-length refractory metal foil by welding two sheets together can now be eliminated. Furthermore, the method of the present invention provides for rolling the refractory metal foil into a coil for annealing purposes and thereafter the coil can be unwrapped for further reduction in thickness without the facially contacting surfaces of the coil sticking together.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A method for producing a refractory metal foil from a workpiece fabricated of a refractory metal material, the workpiece having a workpiece thickness of at least 2.5 inches and a pair of oppositely disposed, parallel lateral edges, comprising the steps of:

(a) heat treating the workpiece for a first time period selected from a first time range of approximately 1.2 hours and 1.8 hours at a first temperature selected from a first temperature range of approximately 2,625° Fahrenheit and 2,675° Fahrenheit and subsequently for a second time period selected from a second time range of approximately 1.7 hours and 2.3 hours at a second temperature selected from a second temperature range of approximately 2,175° Fahrenheit and 2,225° Fahrenheit;

(b) forming said heat-treated workpiece into a sheet of refractory metal material having a first sheet thickness of approximately one inch;

(c) heat treating said sheet of refractory metal material for a third time period selected from a third time range of approximately 1.8 hours and 2.2 hours at a third temperature selected from a third temperature range of approximately 2,175° Fahrenheit and 2,225° Fahrenheit;

(d) compressing said sheet of refractory metal material into a second sheet thickness selected from a second sheet thickness range between 0.060 inches and 0.021 inches;

(e) annealing said sheet of refractory metal material for a first annealing time period selected from a first annealing time range of approximately 1.8 and 2.2 hours at a first annealing temperature selected from a first annealing temperature range of approximately 2,175° Fahrenheit and 2,225° Fahrenheit;

(f) compressing said sheet of refractory metal material into a third sheet thickness selected from a third sheet thickness range of approximately 0.006 inches and 0.021 inches;

(g) annealing said sheet of refractory metal material for a second annealing time period selected from a second annealing time range of approximately 2.8 hours add 3.2 hours at a second annealing temperature selected from a second annealing temperature range of approximately 2,075° Fahrenheit and 2,125° Fahrenheit; and (h) compressing said sheet of refractory metal material into a fourth sheet thickness selected from a fourth sheet thickness range between approximately 0.005 inches and 0.0008 inches thereby forming a foil of refractory metal material.

2. A method according to claim 1 further including the step of grinding the lateral edges of the workpiece before step (a) so that oxide compounds are removed from the lateral edges of the workpiece.

3. A method according to claim 1 wherein compressing said sheet of refractory metal material into one of said third sheet thickness and said fourth sheet thickness is achieved in a Z-mill.

4. A method according to claim 3 wherein said Z-mill includes a roller assembly having at least a pair of rollers disposed in a parallel relationship and cooperative with one another, said roller assembly operative to compress said sheet of refractory metal material as said sheet passes through and between said pair of rollers.

5. A method according to claim 4 wherein said Z-mill includes a pair of coiling assemblies with each disposed on opposite sides of said roller assembly so that when said sheet of refractory metal material passes through and between said pair of rollers, one of said coiling assemblies is operative to receive said sheet of refractory metal material thereby forming a coil of refractory metal material while simultaneously the remaining one of said coil assemblies is operative to discharge said sheet of refractory metal material thereby unwrapping said coil of refractory metal material.

6. A method according to claim 5 wherein as one of said coil assemblies receives said sheet of refractory metal material to form said coil, said one of said coil assemblies is operative to apply a receiving tension force to said sheet as it passes through and between said pair of rollers of said roller assembly and as a remaining one of said coil assemblies discharges said sheet of refractory metal material, said remaining one of said coil assemblies is operative to apply a discharging tension force to said sheet as it passes between and through said pair of rollers of said roller assembly from said remaining one of said coiling assemblies, said discharging tension force being greater than said receiving tension force.

7. A method according to claim 5 wherein annealing the sheet of refractory metal material of steps (e) and (g) includes a furnace having a heating chamber therein sized and adapted to receive said coil of refractory metal material.

8. A method according to claim 7 wherein said coil of refractory metal material is disposed inside said heating chamber having an ambient temperature, said heating chamber and said coil of refractory metal subsequently being heated to said annealing temperature.

9. A method according to claim 1 wherein said second sheet thickness is approximately 0.040 inches.

10. A method according to claim 1 wherein said third sheet thickness is approximately 0.010 inches.

11. A method according to claim 1 wherein said fourth sheet thickness is approximately 0.001 inches.

12. A method according to claim 1 wherein said first time period is approximately 1.5 hours.

13. A method according to claim 1 wherein said second time period is approximately 2.0 hours.

14. A method according to claim 1 wherein said third time period is approximately 2.0 hours.

15. A method according to claim 1 wherein said first annealing time period is approximately 2.0 hours.

16. A method according to claim 1 wherein said second annealing time period is approximately 3.0 hours.

17. A method according to claim 1 wherein said first temperature is approximately 2,650° Fahrenheit.

18. A method according to claim 1 wherein said second temperature is approximately 2,200° Fahrenheit.

19. A method according to claim 1 wherein said third temperature is approximately 2,200° Fahrenheit.

20. A method according to claim 1 wherein said first annealing temperature is approximately 2,200° Fahrenheit.

21. A method according to claim 1 wherein said second annealing temperature is approximately 2,100° Fahrenheit.

22. A method according to claim 1 wherein said refractory metal material is a niobium zirconium alloy.

23. A method for producing a niobium zirconium alloy foil from a workpiece fabricated of a niobium zirconium alloy, the workpiece having a workpiece thickness of at least 2.5 inches and a pair of oppositely disposed, parallel lateral edges, comprising the steps of:

(a) heat treating the workpiece for a first time period selected from a first time range of approximately 1.2 hours and 1.8 hours at a first temperature selected from a first temperature range of approximately 2,625° Fahrenheit and 2,675° Fahrenheit and subsequently for a second time period selected from a second time range of approximately 1.7 hours and 2.3 hours at a second temperature selected from a second temperature range of approximately 2,175° Fahrenheit and 2,225° Fahrenheit;

(b) forming said heat-treated workpiece into a sheet of niobium zirconium alloy having a first sheet thickness of approximately one inch;

(c) heat treating said sheet of niobium zirconium alloy for a third time period selected from a third time range of approximately 1.8 hours and 2.2 hours at a third temperature selected from a third temperature range of approximately 2,175° Fahrenheit and 2,225° Fahrenheit;

(d) compressing said sheet of niobium zirconium alloy into a second sheet thickness selected from a second sheet thickness range between 0.060 inches and 0.021 inches;

(e) annealing said sheet of niobium zirconium alloy for a first annealing time period selected from a first annealing time range of approximately 1.8 and 2.2 hours at a first annealing temperature selected from a first annealing temperature range of approximately 2,175° Fahrenheit and 2.225° Fahrenheit;

(f) compressing said sheet of niobium zirconium alloy in a Z-mill into a third sheet thickness in a third sheet thickness range of approximately 0.006 inches and 0.021 inches;

(g) annealing said sheet of niobium zirconium alloy for a second annealing time period selected from a second annealing time range of approximately 2.8 hours and 3.2 hours at a second annealing temperature selected from a second annealing temperature range of approximately 2,075° Fahrenheit and 2,125° Fahrenheit; and (h) compressing said sheet of niobium zirconium alloy in said Z-mill into a fourth sheet thickness selected from a fourth sheet thickness range between approximately 0.005 inches and 0.0008 inches thereby forming a foil of niobium zirconium alloy.

24. A method according to claim 23 further including the step of grinding the lateral edges of the workpiece before step (a) so that oxide compounds are removed from the lateral edges of the workpiece.

25. A method according to claim 23 wherein said Z-mill includes a roller assembly having at least a pair of rollers disposed in a parallel relationship and cooperative with one another, said roller assembly operative to compress said sheet of niobium zirconium alloy as said sheet passes through and between said pair of rollers.

26. A method according to claim 25 wherein said Z-mill includes a pair of coiling assemblies with each disposed on opposite sides of said roller assembly so that when said sheet of niobium zirconium alloy passes through and between said pair of rollers, one of said coiling assemblies is operative to receive said sheet of niobium zirconium alloy thereby forming a coil of niobium zirconium alloy while simultaneously the remaining one of said coil assemblies is operative to discharge said sheet of niobium zirconium alloy thereby unwrapping said coil of niobium zirconium alloy.

27. A method according to claim 26 wherein as one of said coil assemblies receives said sheet of niobium zirconium alloy to form said coil, said one of said coil assemblies is operative to apply a receiving tension force to said sheet as it passes through and between said pair of rollers of said roller assembly and as a remaining one of said coil assemblies discharges said sheet of niobium zirconium alloy, said remaining one of said coil assemblies is operative to apply a discharging tension force to said sheet as it passes through and between said pair of rollers of said roller assembly from said remaining one of said coiling assemblies, said discharging tension force being greater than said receiving tension force.

28. A method according to claim 23 wherein annealing the sheet of niobium zirconium alloy of steps (e) and (g) includes a furnace having a heating chamber therein sized and adapted to receive said coil of niobium zirconium alloy.

29. A method according to claim 28 wherein said coil of niobium zirconium alloy is disposed inside said heating chamber having an ambient temperature, said heating chamber and said coil of refractory metal subsequently being heated to said first and second annealing temperatures.

* * * * *